US005390370A

United States Patent [19]

Koy

[11] Patent Number: 5,390,370

[45] Date of Patent: Feb. 21, 1995

[54] KNOT SUPPORT FOR PRE-TIED NECKTIE

[76] Inventor: Sherry Koy, 21805 Arline Ave., Hawaiian Gardens, Calif. 90716

[21] Appl. No.: 102,794

[22] Filed: Aug. 6, 1993

[51] Int. Cl.[6] ..... A41D 25/02; A41D 25/00

[52] U.S. Cl. ..... 2/153; 2/148; 2/150; 2/152.1

[58] Field of Search ..... 2/148, 149, 150, 152.1, 2/144, 145, 153, 146, 147, 154, 155, 156

[56] References Cited

U.S. PATENT DOCUMENTS

| | | | |
|---|---|---|---|
| 2,669,724 | 2/1954 | Jarrett | 2/153 |
| 3,820,166 | 6/1974 | Gouner | 2/153 |
| 4,656,672 | 4/1987 | Lande | 2/153 X |
| 4,710,982 | 12/1987 | Lande | 2/153 X |
| 4,835,794 | 6/1989 | Chen et al. | 2/150 |
| 5,048,127 | 9/1991 | Yang | 2/150 X |

*Primary Examiner*—Jeanette E. Chapman
*Attorney, Agent, or Firm*—John B. Dickman, III

[57] ABSTRACT

A necktie knot supporting means having a hollow upper section and a lower tongue section where the knot supporting means tapers from the hollow upper section to the lower tongue section, and a bracket for supporting a zipper fastener. Where the zipper fastener interlocks and unlocks a neck embracing loop. A necktie front panel secured to the knot supporting means for tying a knot about the knot supporting means.

There is a vertical groove running from the tongue section onto the hollow upper section to provide an indentation which allows a more natural looking knot to be tied.

2 Claims, 2 Drawing Sheets

KNOT SUPPORT FOR PRE-TIED NECKTIE

BACKGROUND OF THE INVENTION

The present invention relates generally to pre-tied neckties and, more particularly, to a pre-tied necktie knot support.

Heretofore, neckties were tied each time they were worn. When a necktie is tied and untied, the area where the knot is formed often becomes wrinkled or distorted. In addition, the user seldom ties the same knot each time, leading to misshaped knots. There have been at least two solutions to these problems: the well known clip on necktie, and the more recent necktie having a pre-tied knot which fits around the user's neck and is adjustable by a means of a slidable zipper. Such a necktie is described in other U.S. Patents, including U.S. Pat. Nos. 3,942,192, 4,656,672 and 5,048,127. The U.S. Pat. No. 3,942,192 has a knot supporting means with a necktie front panel permanently attached to it and tied into a knot. A neck loop is slidably attached to the knot supporting means to adjust the size of the loop to fit around a user's neck. The neck loop has a zipper sewn to the inner edge of the loop. There is a zipper slide gripping tab which secures the neck loop to the knot supporting means by a bracket and a protuberance to adjust the loop size.

Another pre-tied necktie is shown in U.S. Pat. No. 4,656,672 where the zipper slide is secured to a knot supporting means. The zipper slide has an elongated hooking member with a through hole in which a gripper tab is normally mounted. The gripper tab is removed so that the elongated hooking member will snap into a slot in the knot supporting member to adjust the size of a necktie loop.

In U.S. Pat. No. 5,048,127, the zipper slide attaches to the knot supporting member similar to the one in U.S. Pat. No. 3,942,192, where the gripping tab is secured to the knot supporting member by a bracket and a protuberance.

The knot supporting member, in most all of the prior art, has a generally triangular shape with a means to support the knot formed by the permanently attached necktie panel, and guide the neck loop. In addition to the above listed patents, U.S. Pat. Nos. 4,513,453 and 4,710,982 are of interest to the present invention. These patents describe a knot supporting member having a generally triangular shape with a closed loop projecting from it to guide a necktie loop. The face of the knot supporting member, the triangular-shape, has an arcuate curve with the closed loop having the same arcuate curve parallel to the arcuate curve of the face.

SUMMARY OF THE INVENTION

The present invention provides a knot supporting means for a pre-tied necktie which combines a zipper slide securing means and a triangular shaped knot supporting member with a closed loop to support a necktie Knot and a necktie adjustable loop. The knot supporting means has a front face with a generally triangular shape. The lower portion of the front face has a tongue with a protuberance and a bracket to receive and secure a zipper slide gripping tab.

The triangular shaped face of the knot supporting member has an arcuately curved cross-section which aids in forming a soft necktie knot. Integral with the front face and depending from it is a closed loop. In cross-section, the loop has one portion, which is the back of the face of the knot supporting member, that is arcuately curved and a second portion with the same arcuate curve of the face to be parallel with the face. The closed loop has two functions; the first is to guide the necktie loop and the second is to provide a support for the necktie knot.

BRIEF DESCRIPTION OF THE DRAWINGS

Referring to the drawings FIGS. 1–9 the necktie of the invention has a rigid knot supporting means 10 shown in FIG. 3. Looking at FIGS. 1 and 2 a necktie is shown having a front panel 12 and a neck embracing loop 14, hereinafter referred to as a neck loop, being tied about rigid knot supporting means 10. In FIG. 1, the front panel 12 is fixed to the rigid knot supporting means 10 by a rivet 16. Front panel 12 is wrapped around the rigid knot support means 10 to form a knot portion. The neck loop 14 has a loop 18, with a lower end designated as 20 which extends through an opening in the rigid knot support means 10.

Figure 1:
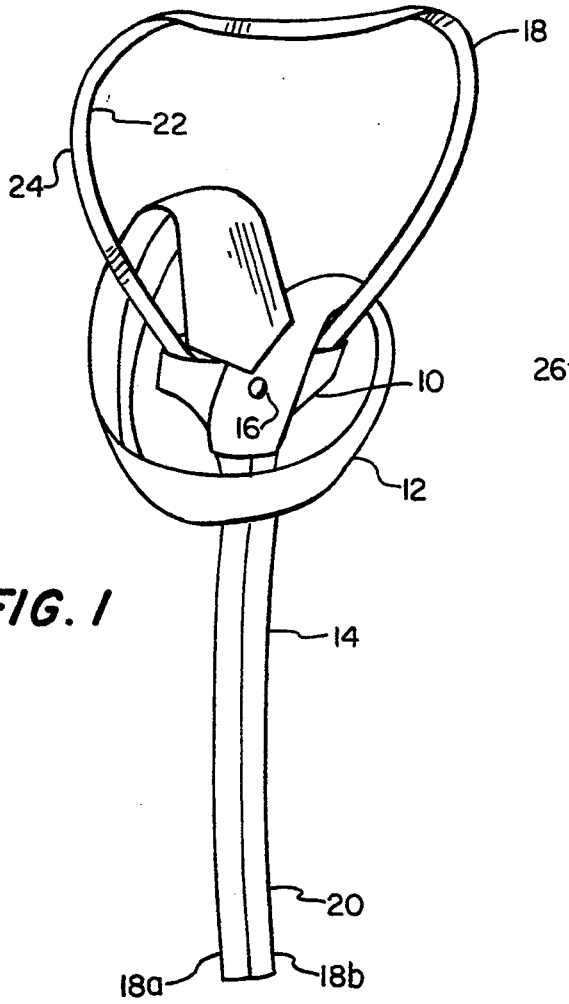
FIG. 1 is a front view of an embodiment of the invention illustrating the wrapping of the front tie portion about a rigid knot supporting means to form a knot.

The neck loop 14 may be made from a single slide fastener stringer or loop 18 which is provided with a continuous string 22 of slide fastener coupling elements of identical construction along an edge of the loop. A border 24 of similar material as the front tie panel 12 is sewn along the side of loop 18.

The front panel 12 and the neck loop 14 are not shown in FIGS. 3 to 6 which illustrate the rigid knot supporting means 10. The rigid knot supporting means 10 has a hollow upper section 26, the front of which tapers downwardly in a generally triangular shape to a tongue portion 28. A zipper slide fastener 30, FIG. 7, of well known construction is secured within the hollow opening 26 in the rigid knot supporting means 10 dividing the hollow opening into two portions. The slide fastener is attached to a gripping tab 32 which is removably attached to the tongue portion 28 of the triangular-shaped front of the rigid knot supporting means.

In order to attach the gripping tab 32 to the tongue portion 28, a U-shaped bracket 34 is provided on the back of the tongue portion. Positioned below the bracket 34 is an inclined post 36 to engage hole 38 in gripping tab 32. The gripping tab 32 is slid into bracket 34 and pressed over inclined post 36 to where hole 38 is engaging the post. To remove the zipper slide fastener 30, the gripping tab 32 is pried off of the post 36 and them pulled up through the bracket 34.

The neck loop 14 having a loop 18 with ends 18*a* and 18*b* of the loop are manipulated so that the ends are pushed through respective openings 30*a* and 30*b* of zipper slide fastener 30 to interlock opposing coupling elements of the single slide fastener loop. In this way not only is the loop 18 formed but also the lower end 20.

In order to wear the necktie described, if the loop is not sufficiently large enough to pass over the head, the knot portion is gripped with one hand and the loop 18 is pulled with one hand. The loop is then passed over the head and positioned. The necktie is snuggled around the neck by gripping the knot portion with one hand and pulling the lower end 20 down with the other hand to cause the knot portion to move upwardly under the wearer's neck. The operation is reversed to remove the necktie.

Figure 3:
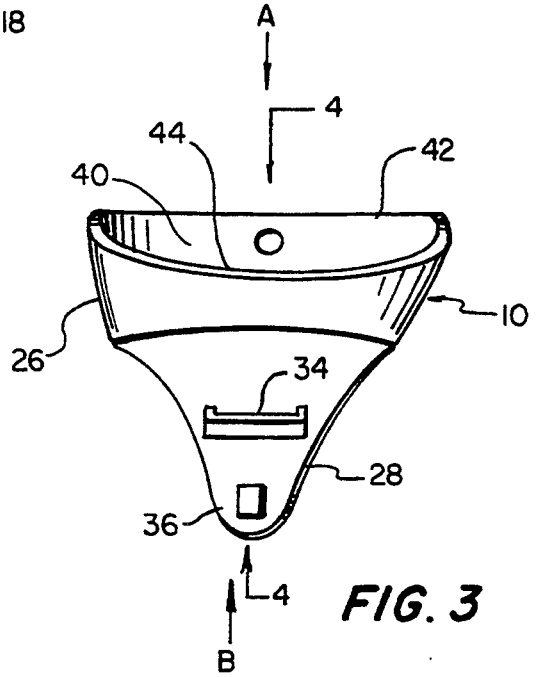
FIG. 3 is a perspective view from the back side of the rigid knot supporting means used for the embodiment illustrated in FIG. 1.
Figure 4:
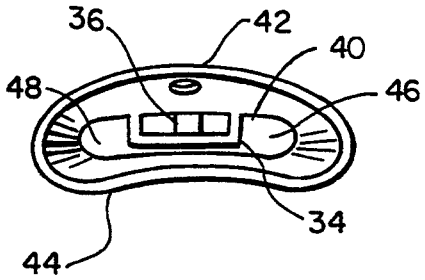
FIG. 4 is an end view taken along the line 4—4 of FIG. 3, looking in the direction of Arrow A.
Figure 2:
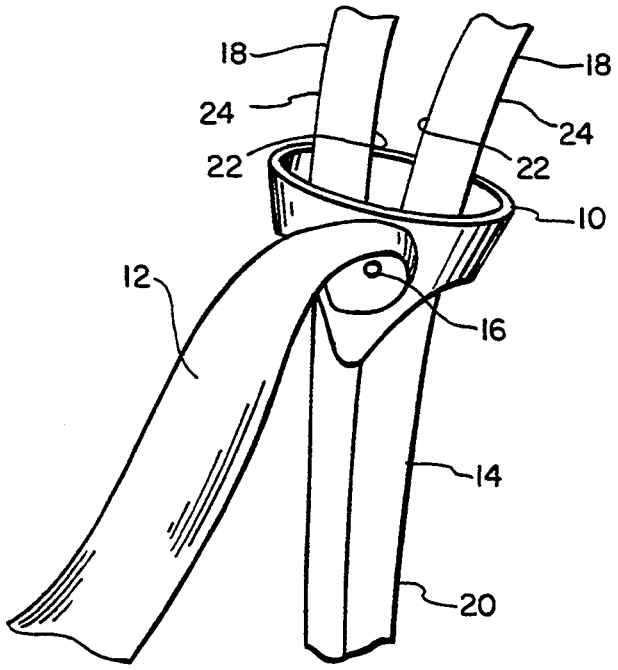
FIG. 2 is a partial perspective view of the embodiment of the FIG. 1 view from the front before the front tie portion is wrapped around the rigid knot supporting means to form a knot.
Figure 5:
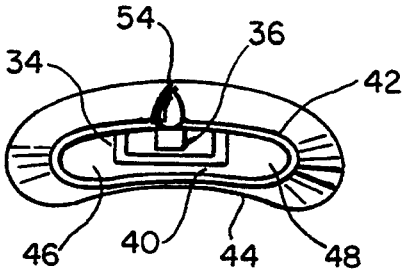
FIG. 5 is an end view taken along the line 4—4 of FIG. 3 looking in the direction of Arrow B.
Figure 6:
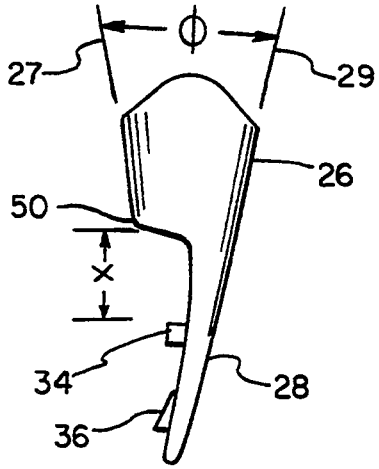
FIG. 6 is a side view of the rigid knot supporting means of the invention.
Figure 7:
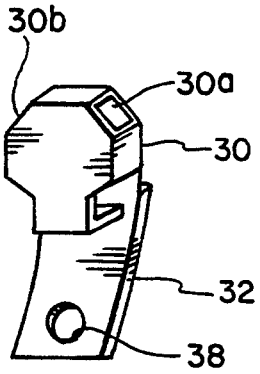
FIG. 7 is a perspective view of a zipper slide fastener.

A closer look at the knot supporting means 10 particularly FIGS. 3, 4 and 5 shows a hollow opening 40 provided by the face portion 42 and an integral rear loop portion 44. Face portion 42 and rear loop portion 44 are substantially equidistant from one another. Since face portion 42 has an arcuate curve, it follows that rear loop portion 44 also has a similar arcuate curve equidistant from the face portion. The tapering shape of the hollow upper section 26 combined with the integral face portion 42 and rear loop portion 44 provide a gentle surface for a necktie knot and a guide for the ends of the neck loop 18. The tongue portion 28 and the rear loop portion 44 form an intersecting angle $\phi$ following imaginary lines 27 and 29, as shown in FIG. 6. Angle $\phi$ is at or about six degrees. With the zipper slide fastener 30 installed in the knot supporting means 10, the lower end of the tongue portion 28 divides the hollow opening into two guide restriction channels 46 and 48, FIGS. 4 and 5. The guide restriction channels permit the ends of loop 18 to slide through the channels with restriction on the loop to aid the zipper slide fastener 30 in keeping a neat, tight knot, the neck loop 18 being drawn comfortably tight around a user's neck.

The distance "x" between the bottom edge 50 of the rear loop portion 44 and the bracket 34 is about $\frac{3}{8}$ of an inch. This distance "x" is important in that when the zipper slide fastener 30 is in place, the hollow opening is partially blocked to create channels 46 and 48.

The zipper slide fastener 30 is attached to the knot supporting means 10 by inserting the gripping tab 32 in bracket and securing it on post 34. The zipper slide fastener is of a size to fill the distance "x" between edge 50 of the rear loop 44. In general, a zipper slide fastener has a length of $\frac{3}{8}$ of an inch. Knot supporting means 10 with its hollow upper section 26, formed by the face portion 42 and rear loop 44, provide a guide for the ends of neck loop 18. With zipper slide fastener 30 in place and the tapered upper section 26, a pair of guide restriction channels 46 and 48 are formed. Channels 46 and 48, as stated, restrict the sliding of neck loop 18, which would loosen the necktie.

Figure 8:
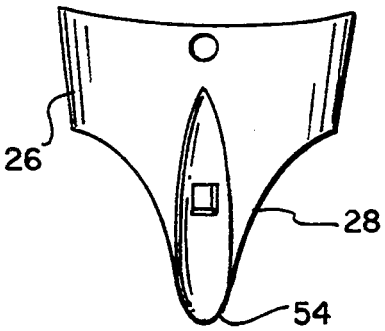
FIG. 8 is a front view of a rigid knot supporting means.
Figure 9:
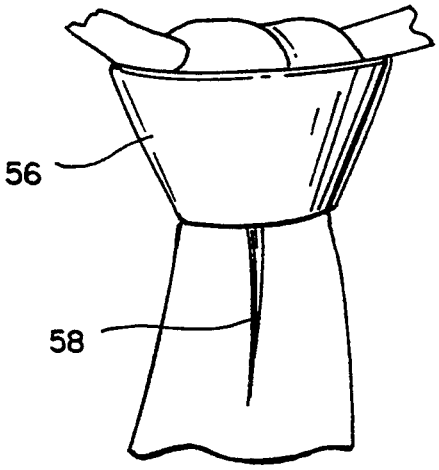
FIG. 9 is a front view of a tied necktie.

Referring to FIG. 8 the rigid knot supporting means 10 is shown having a groove 54. Groove 54 extends vertically up the front of tongue portion 28 and continues up the front of hollow upper section 26. The indentation created by the groove 54 functions to provide a more natural looking knot 56 with a fold 58 in the front of a tie, as shown in FIG. 9.

When a necktie knot 56 is drawn tight around the rigid knot supporting means 10 an un-natural puffing occurs, when there is no groove 54. With a groove 54, the front panel 12 tends to gather in the groove 54 to provide the natural-looking fold.

While only one embodiment of the invention has been disclosed, one should study the drawings, description and claims for a complete understanding of the invention.

I claim:

1. A necktie knot supporting means where a necktie having a first tie portion includes a neck embracing loop having a lower end, inner edges provided with interlockable means; a zipper slide having means to interlock and unlocking said interlockable means and a gripping tab to vary the size of the loop; and a second tie portion having an upper end for securing to said necktie knot supporting means to form a knot portion, and the remainder of said second tie portion depending from said necktie knot supporting means to form a front depending panel; said necktie knot supporting means comprising:

a front panel having a triangular shape with a lower tongue section, a hollow upper section including said front panel and a rear loop, where said front panel and said rear loop are equidistant, said front panel and said rear loop having arcuate carves; said hollow upper section tapering downwardly to said lower tongue section; said front panel having a backside with a u-shaped bracket means and an inclined post means fixed to said lower tongue section to receive a gripping tab of a zipper slide, where the gripping tab is removably attached to said lower tongue section by sliding the gripping tab into said bracket and engaging said inclined post means, said front panel and said lower tongue section and said rear loop forming an angle "$\phi$" defined by a line extending through said rear loop and intersecting said lower tongue section at its lowest point; and said rear loop having a lower edge where a distance "x" between said lower edge and said u-shaped bracket is equal to the length of a zipper slide, whereby said hollow upper section has a pair of guide channels formed by installing a zipper slide in said u-shaped bracket means for guiding and restricting movement of said neck embracing loop.

2. A necktie having a rigid knot supporting means as in claim 1 wherein said angle $\phi$ is 6 degrees.

* * * * *